US008175870B2

(12) United States Patent
Gao

(10) Patent No.: US 8,175,870 B2
(45) Date of Patent: May 8, 2012

(54) DUAL-PULSE EXCITED LINEAR PREDICTION FOR SPEECH CODING

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 727 days.

(21) Appl. No.: 11/942,066

(22) Filed: Nov. 19, 2007

(65) Prior Publication Data

US 2008/0154586 A1 Jun. 26, 2008

Related U.S. Application Data

(60) Provisional application No. 60/877,172, filed on Dec. 26, 2006.

(51) Int. Cl.
*G10L 19/12* (2006.01)

(52) U.S. Cl. ..... 704/223

(58) Field of Classification Search ..... 704/223
See application file for complete search history.

(56) References Cited

U.S. PATENT DOCUMENTS 6,928,406 B1 * 8/2005 Ehara et al. ..... 704/223

* cited by examiner

*Primary Examiner* — Jakieda Jackson
(74) *Attorney, Agent, or Firm* — Huawei Technologies Co., Ltd.

(57) ABSTRACT

The invention proposed a Dual-Pulse Excitation Model; wherein two pulses of each pair of pulses are always adjacent each other. Only one position index for each pair of pulses needs to be sent to the decoder, which saves bits to code all pulse positions. The magnitudes of each pair of pulses have limited number of patterns. Because the two pulses are adjacent each other, each pair of pulses with different magnitudes can produce different high-pass and/or low-pass effect. Since the magnitudes have enough variation, it is possible to assign the candidate positions of each pair of pulses within a small range in order to save the searching complexity.

9 Claims, 8 Drawing Sheets

Basic CELP Speech Encoder

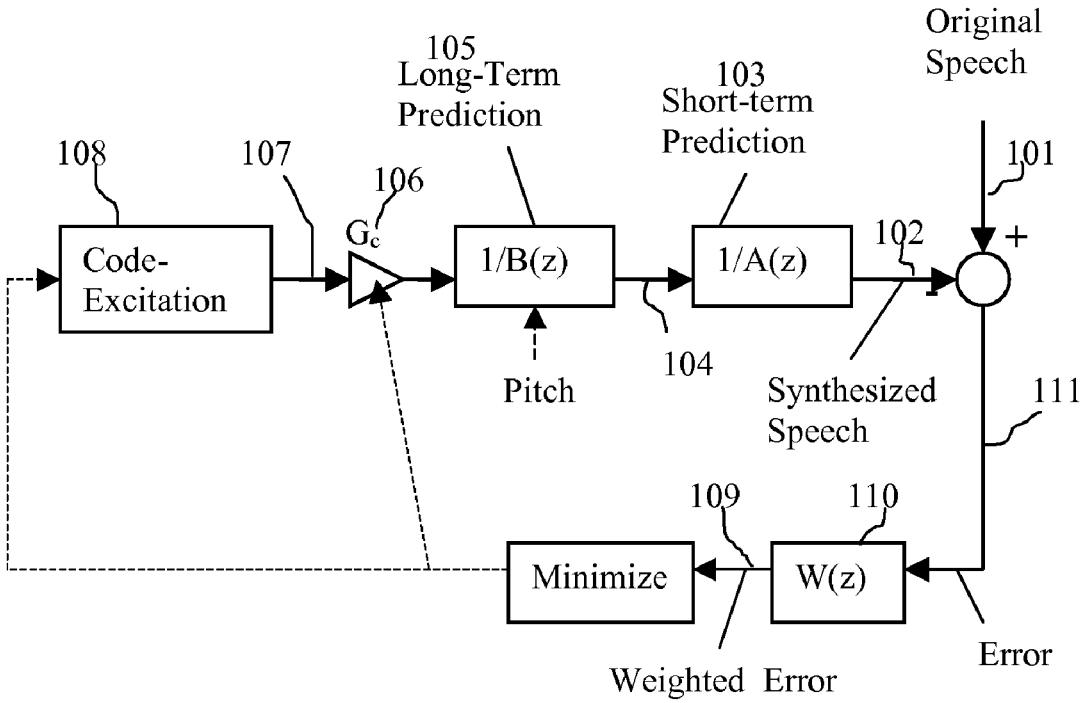
FIG. 1 Initial CELP Speech Encoder

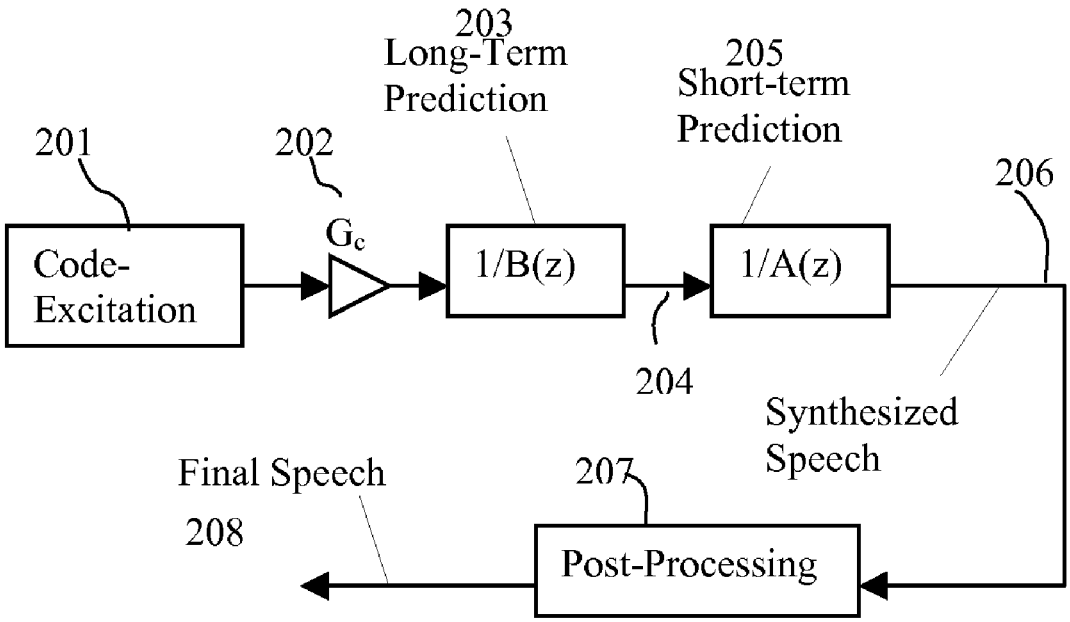
FIG. 2 Initial CELP Speech Decoder

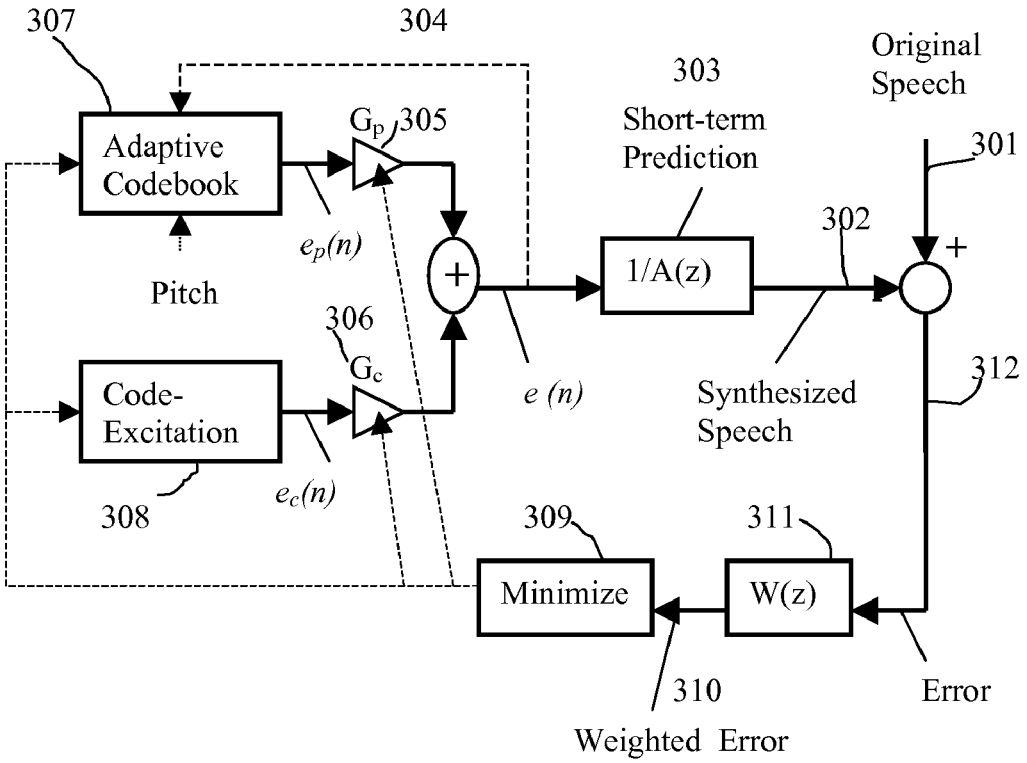
FIG.3 Basic CELP Speech Encoder

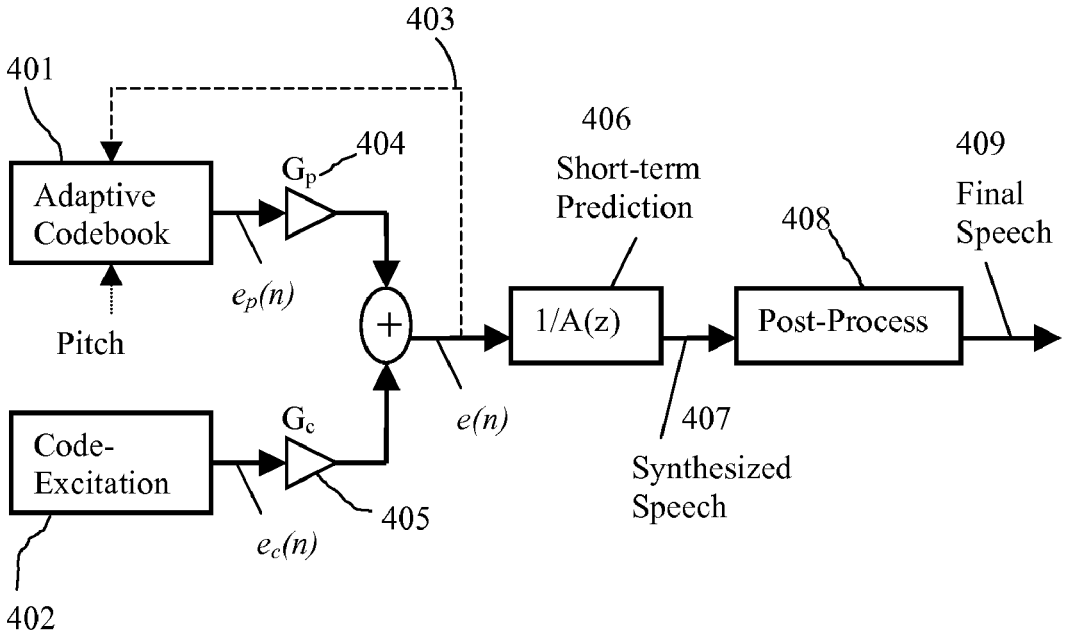
FIG.4 Basic CELP Speech Decoder

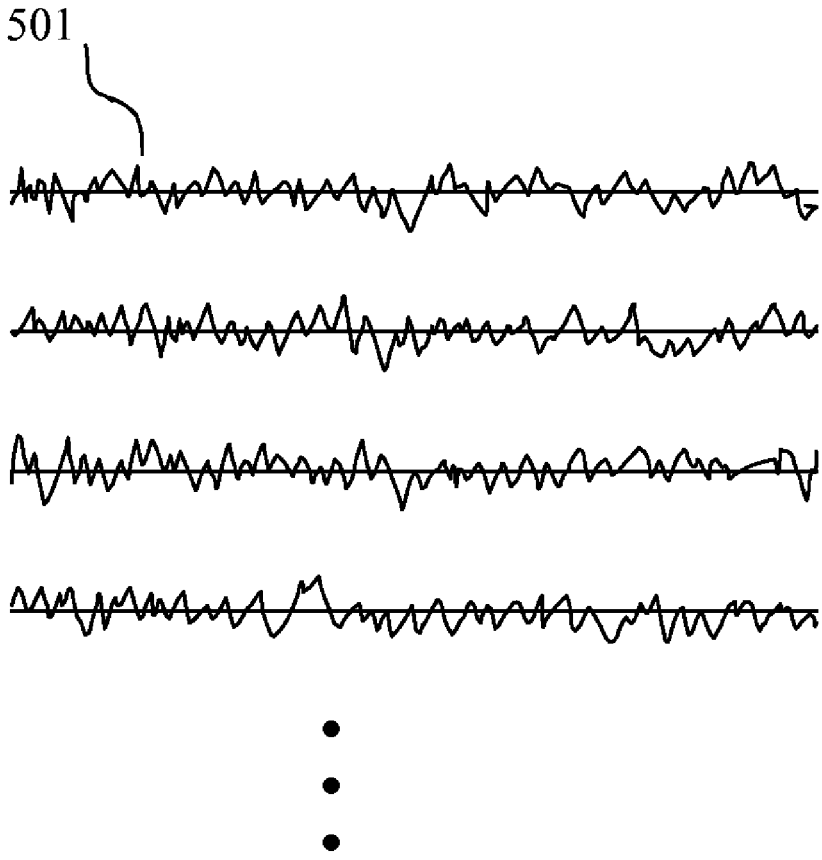
FIG.5 Stochastic (Random) Noise Excitation Codebook

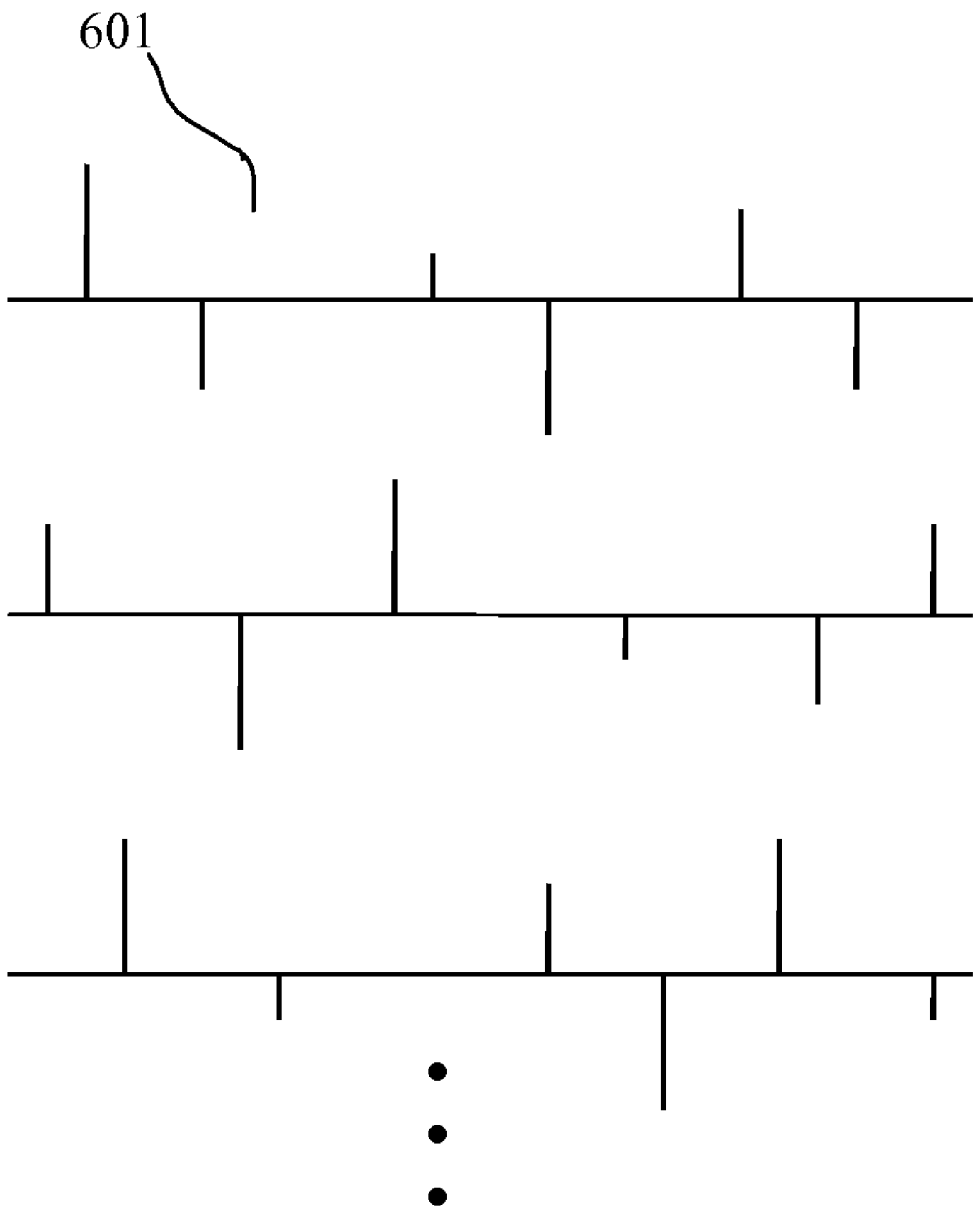
FIG.6 Multi- Pulse Excitation Codebook

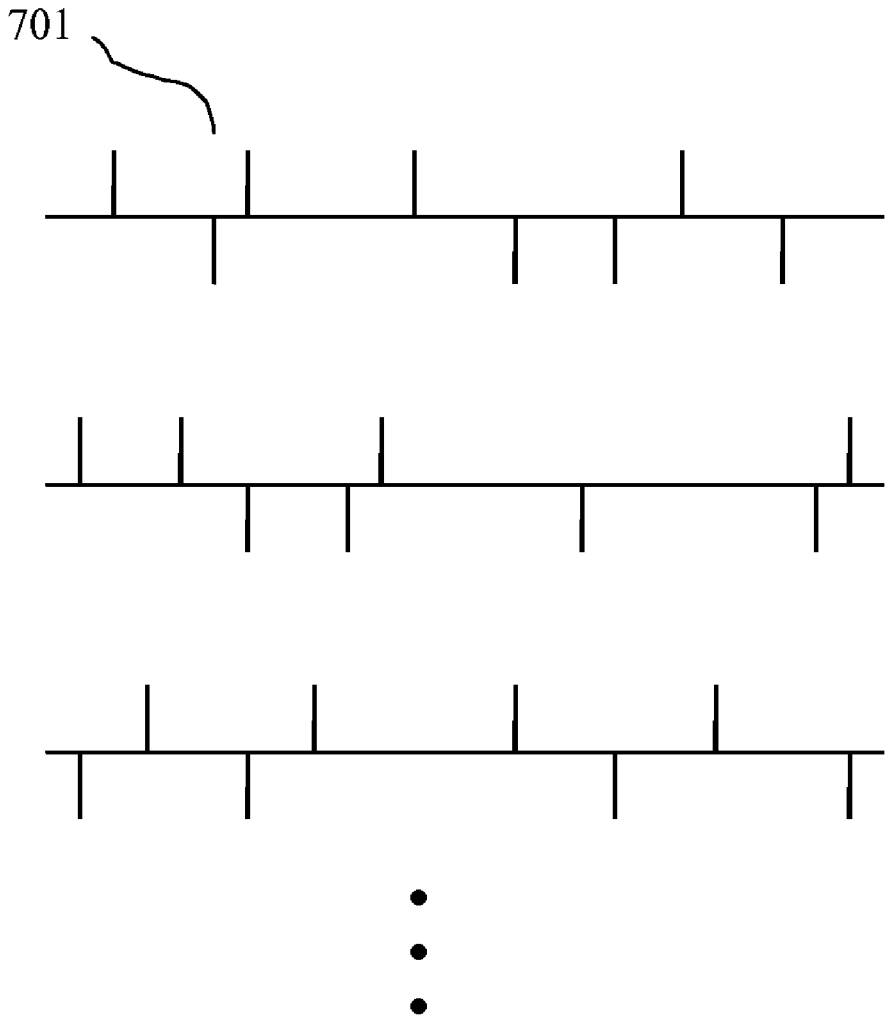
FIG.7 Binary(ACELP) Pulse Excitation Codebook

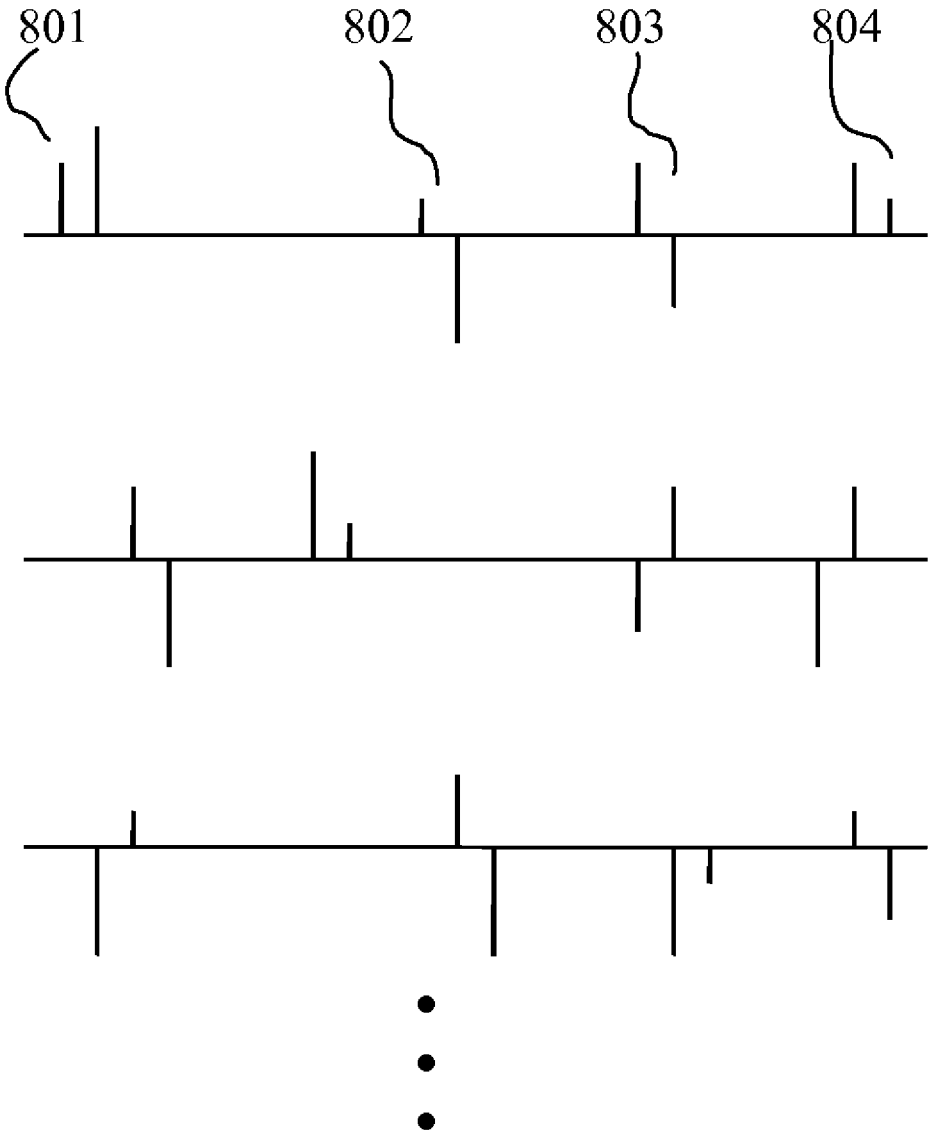
FIG.8 Proposed Dual-Pulse Excitation Codebook

DUAL-PULSE EXCITED LINEAR PREDICTION FOR SPEECH CODING

CROSS REFERENCE TO RELATED APPLICATIONS

Provisional Application No. U.S. 60/877,171
Provisional Application No. U.S. 60/877,173

BACKGROUND OF THE INVENTION

1. Field of the Invention

The present invention is generally in the field of signal coding. In particular, the present invention is in the field of speech coding and specifically in improving the excitation performance.

2. Background Art

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced. For voiced speech, the speech signal is essentially periodic; however, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction. As for the unvoiced speech, the signal is more like a random noise and has a smaller amount of periodicity.

In either case, parametric coding may be used to reduce the redundancy of the speech segments by separating the excitation component of the speech from the spectral envelop component. The slowly changing spectral envelope can be represented by Linear Prediction (also called Short-Term Prediction). A low bit rate speech coding could also benefit a lot from exploring such a Short-Term Prediction. The coding advantage arises from the slow rate at which the parameters change. Yet, it is rare for the parameters to be significantly different from the values held within a few milliseconds. Accordingly, at the sampling rate of 8 k Hz or 16 k Hz, the speech coding algorithm is such that the nominal frame duration is in the range of ten to thirty milliseconds. A frame duration of twenty milliseconds seems to be the most common choice. In more recent well-known standards such as G.723, G.729, EFR or AMR, the Code Excited Linear Prediction Technique ("CELP") has been adopted; CELP is commonly understood as a technical combination of Coded Excitation, Long-Term Prediction and Short-Term Prediction. Code-Excited Linear Prediction (CELP) Speech Coding is a very popular algorithm principle in speech compression area.

FIG. 1 shows the initial CELP encoder where the weighted error 109 between the synthesized speech 102 and the original speech 101 is minimized by using a so-called analysis-by-synthesis approach. W(z) is the weighting filter 110. 1/B(z) is a long-term linear prediction filter 105; 1/A(z) is a short-term linear prediction filter 103. The code-excitation 108, which is also called fixed codebook excitation, is scaled by a gain $G_c$ 107 before going through the linear filters.

FIG. 2 shows the initial decoder which adds the post-processing block 207 after the synthesized speech.

FIG. 3 shows the basic CELP encoder which realized the long-term linear prediction by using an adaptive codebook 307 containing the past synthesized excitation 304. The periodic information of pitch is employed to generate the adaptive component of the excitation. This excitation component is then scaled by a gain $G_p$ 305 (also called pitch gain). The two scaled excitation components are added together before going through the short-term linear prediction filter 303. The two gains ($G_p$ and $G_c$) need to be quantized and then sent to the decoder.

FIG. 4 shows the basic decoder, corresponding to the encoder in FIG. 3, which adds the post-processing block 408 after the synthesized speech.

The total excitation to the short-term linear filter 303 is a combination of two components; one is from the adaptive codebook 307; another one is from the fixed codebook 308. For strong voiced speech, the adaptive codebook contribution plays important role because the adjacent pitch cycles of voiced speech are similar each other, which means mathematically the pitch gain $G_p$ is very high. The fixed codebook contribution is needed for both voiced and unvoiced speech. The combined excitation can be expressed as $$e(n)=G_p \cdot e_p(n)+G_c \cdot e_c(n) \tag{1}$$

where $e_p(n)$ is one subframe of sample series indexed by n, coming from the adaptive codebook 307 which consists of the past excitation 304; $e_c(n)$ is from the coded excitation codebook 308 (also called fixed codebook) which is the current excitation contribution. For voiced speech, the contribution of $e_p(n)$ from the adaptive codebook could be significant and the pitch gain $G_p$ 305 is around a value of 1. The excitation is usually updated for each subframe. Typical frame size is 20 milliseconds and typical subframe size is 5 milliseconds.

The excitation form from the fixed codebook 308 had a long history. Three major factors influence the design of the coded excitation generation. The first factor is the perceptual quality; the second one is the computational complexity; the third one is memory size required.

FIG. 5 shows the very initial model of the excitation consisting of random noise excitation 501. The noise excitation can produce good quality for unvoiced speech but not good for voiced speech. The computational complexity of searching the best noise vector is pretty high due to the assumption that every sample is non-zero. Theoretically, all the noise candidate vectors need to be memorized. The best noise vector is selected and the index of the best noise vector is sent to the decoder.

FIG. 6 shows another famous pulse-based excitation model called Multi-Pulse Excitation in which the pulse position and the magnitude of every possible pulse need to be coded and sent to the decoder. The pulse excitation can produce good quality for voiced speech; but this model requires relatively higher bit rate to code all possible pulse positions and pulse magnitudes.

FIG. 7 shows a variant pulse excitation model (also called ACELP excitation model or Binary excitation model) in which each pulse position index needs to be sent to the decoder; however all the magnitudes are assigned to a constant of value 1 except the magnitude signs (+1 or −1) need to be sent to the decoder. Because the magnitudes are constant, it saves bits to code the magnitudes and it also saves the computational load during the searching of the best pulse positions. Also because the magnitudes are constant, it requires more global searching of the best binary vector and it might not be efficient when the bit-rate increases. This is currently the most popular excitation model which is used in several international standards.

This invention will propose an excitation model which is different from the three above described models and has advantages in perceptual quality, computational load, and memory requirement.

SUMMARY OF THE INVENTION

In accordance with the purpose of the present invention as broadly described herein, there is provided model and system for speech coding.

The invention proposed a Dual-Pulse Excitation Model; wherein two pulses of each pair are always adjacent each other. Only one position index for each pair of pulses needs to be sent to the decoder, which saves bits to code all pulse positions. The magnitudes of each pair of pulses have limited number of patterns. Because the two pulses are adjacent each other, each pair of pulses can produce different high-pass or low-pass effect, additional to different magnitudes. Since the magnitudes are not constant, it is possible to assign the candidate positions of each pair of pulses within a small range in order to save the searching complexity.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1 shows the initial CELP encoder.

FIG. 2 shows the initial decoder which adds the post-processing block.

FIG. 3 shows the basic CELP encoder which realized the long-term linear prediction by using an adaptive codebook.

FIG. 4 shows the basic decoder corresponding to the encoder in FIG. 3.

FIG. 5 shows the very initial model of the excitation consisting of random noise excitation.

FIG. 6 shows another famous pulse-based excitation model called Multi-Pulse Excitation.

FIG. 7 shows a variant binary pulse excitation model.

FIG. 8 proposes a Dual-Pulse Excitation model.

DETAILED DESCRIPTION OF THE INVENTION

The present invention discloses a Dual-Pulse Excitation model which improves quality and reduces complexity for a moderate bit rate or a bit rate from medium to high. The following description contains specific information pertaining to the Code Excited Linear Prediction Technique (CELP). However, one skilled in the art will recognize that the present invention may be practiced in conjunction with various speech coding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

FIG. 1 shows the initial CELP encoder where the weighted error 109 between the synthesized speech 102 and the original speech 101 is minimized often by using a so-called analysis-by-synthesis approach. W(z) is an error weighting filter 110. 1/B(z) is a long-term linear prediction filter 105; 1/A(z) is a short-term linear prediction filter 103. The coded excitation 108, which is also called fixed codebook excitation, is scaled by a gain $G_c$ 107 before going through the linear filters. The short-term linear filter 103 is obtained by analyzing the original signal 101 and represented by a set of coefficients:

$$A(z) = \sum_{i=1}^{P} 1 + a_i \cdot z^i, \quad i = 1, 2, \ldots, P \tag{2}$$

The weighting filter 110 is somehow related to the above short-term prediction filter. A typical form of the weighting filter could be $$W(z) = \frac{A(z/\alpha)}{A(z/\beta)}, \tag{3}$$

where $\beta<\alpha$, $0<\beta<1$, $0<\alpha\leqq 1$. The long-term prediction 105 depends on pitch and pitch gain; a pitch can be estimated from the original signal, residual signal, or weighted original signal. The long-term prediction function in principal can be expressed as $$B(z)=1-\beta\cdot z^{-Pitch} \tag{4}$$

The coded excitation 108 normally consists of pulse-like signal or noise-like signal, which are mathematically constructed or saved in a codebook. Finally, the coded excitation index, quantized gain index, quantized long-term prediction parameter index, and quantized short-term prediction parameter index are transmitted to the decoder.

FIG. 2 shows the initial decoder which adds the post-processing block 207 after the synthesized speech 206. The decoder is a combination of several blocks which are coded excitation 201, long-term prediction 203, short-term prediction 205 and post-processing 207. Every block except post-processing has the same definition as described in the encoder of FIG. 1. The post-processing could further consist of short-term post-processing and long-term post-processing.

FIG. 3 shows the basic CELP encoder which realized the long-term linear prediction by using an adaptive codebook 307 containing the past synthesized excitation 304. The periodic pitch information is employed to generate the adaptive component of the excitation. This excitation component is then scaled by a gain 305 ($G_p$, also called pitch gain). The two scaled excitation components are added together before going through the short-term linear prediction filter 303. The two gains ($G_p$ and $G_c$) need to be quantized and then sent to the decoder.

FIG. 4 shows the basic decoder corresponding to the encoder in FIG. 3, which adds the post-processing block 408 after the synthesized speech 407. This decoder is similar to FIG. 2 except the adaptive codebook 307. The decoder is a combination of several blocks which are coded excitation 402, adaptive codebook 401, short-term prediction 406 and post-processing 408. Every block except post-processing has the same definition as described in the encoder of FIG. 3. The post-processing could further consist of short-term post-processing and long-term post-processing.

FIG. 3 illustrates a block diagram of an example encoder capable of embodying the present invention. With reference to FIG. 3 and FIG. 4, the total excitation to the short-term linear filter 303 is a combination of two components; one is from the adaptive codebook 307; another one is from the fixed codebook 308. For strong voiced speech, the adaptive codebook contribution plays important role because the adjacent pitch cycles of voiced speech are similar each other, which means mathematically the pitch gain $G_p$ is very high. The fixed codebook contribution is needed for both voiced and unvoiced speech. The combined excitation can be expressed as $$e(n)=G_p \cdot e_p(n)+G_c \cdot e_c(n) \quad (5)$$

where $e_p(n)$ is one subframe of sample series indexed by n, coming from the adaptive codebook 307 which consists of the past excitation 304; $e_c(n)$ is from the coded excitation codebook 308 (also called fixed codebook) which is the current excitation contribution. For voiced speech, the contribution of $e_p(n)$ from the adaptive codebook could be significant and the pitch gain $G_p$ 305 is around a value of 1. The excitation is usually updated for each subframe. Typical frame size is 20 milliseconds and typical subframe size is 5 milliseconds.

The excitation form from the fixed codebook 308 had a long history. Three major factors influence the design of the coded excitation generation. The first factor is the perceptual quality; the second one is the computational complexity; the third one is memory size required.

FIG. 5 shows the very initial model of the excitation consisting of random noise excitation 501. The noise excitation can produce good quality for unvoiced speech but not good for voiced speech. Usually, the computational complexity of searching the best noise vector is pretty high due to the assumption that every sample is non-zero. Traditionally, all the noise candidate vectors need to be memorized. The best noise vector is selected and the index of the best noise vector is sent to the decoder.

FIG. 6 shows another famous pulse-based excitation model called Multi-Pulse Excitation in which the pulse position and the magnitude of every possible pulse need to be coded and sent to the decoder. The pulse excitation can produce good quality for voiced speech; but this model requires relatively higher bit rate to code all possible pulse positions and pulse magnitudes.

FIG. 7 shows a variant pulse excitation model (also called ACELP excitation model or Binary excitation model) in which each pulse position index needs to be sent to the decoder; however all the magnitudes are assigned to a constant of value 1 and only the magnitude signs (+1 or −1) need to be sent to the decoder. Because the magnitudes are constant, it saves bits to code the magnitudes and it also saves the computational load during the searching of the best pulse positions. Also because the magnitudes are constant, it requires more global searching of the best binary vector and it might not be efficient when the bit-rate increases. This is currently the most popular excitation model which is used in several international standards such as ITU G.729 ACELP at 8 kbps.

This invention will propose an excitation model which is different from the three above described models and has advantages in perceptual quality, computational load, and memory requirement.

The proposed Dual-Pulse Excitation Model is shown in FIG. 8 where two pulses of each pair are always adjacent to each other. Only one position index for each pair of pulses needs to be sent to the decoder, which requires less bits to code the position than sending two pulse positions. Let's assume the subframe size is 40 samples; here is an example of the candidate positions (positions of first pulse of each pair) of 6 pulse pairs 1th pulse pair candidate positions:
0, 1, 2, 3, 4, 5, 6, 7

2th pulse pair candidate positions:
6, 7, 8, 9, 10, 11, 12, 13

3th pulse pair candidate positions:
12, 13, 14, 15, 16, 17, 18, 19

4th pulse pair candidate positions:
18, 19, 20, 21, 22, 23, 24, 25

5th pulse pair candidate positions:
25, 26, 27, 28, 29, 30, 31, 32

6th pulse pair candidate positions:
32, 33, 34, 35, 36, 37, 38, 39

In this example, 3 bits needs to be used to code the position of each pair of pulses and the best position index for each pair of pulses is sent to decoder.

The magnitudes of each pair of pulses have limited number of patterns. The magnitude pattern index needs to be sent to the decoder. Here is an example of the 4 magnitude patterns for each pair of pulses (P1, P2):

(1., −0.2), (0.5, −0.2), (1., −0.85), (0.5, −0.85)

In this example, 2 bits needs to be used to code the magnitudes of each pair of pulses and the best magnitude index for each pair of pulses is sent to decoder. Because the two pulses are adjacent each other, their magnitude combination can produce different high-pass or low-pass effect. In FIG. 8, pulse pair 801 and pulse pair 804 have low-pass effect; pulse pair 802 and pulse pair 803 have high-pass effect. During the design of speech codec, if high-pass effect needs to be enhanced, the candidate set of pulse pair magnitudes could contain more high-pass patterns; if low-pass effect needs to be enhanced, the candidate set of pulse pair magnitudes could contain more low-pass patterns.

Since the magnitudes are not constant and they have some energy variation, it is possible to assign the candidate positions of each pair of pulses within a small range and do only local weighted error minimization during the searching of the best dual-pulse combination. For example, the position searching complexity for the candidate positions of {0, 1, 2, 3, 4, 5, 6, 7} could be much lower than searching in the range of {0, 5, 10, 15, 20, 25, 30, 35}. The best position and magnitude of each pair of pulses can be jointed searched.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A speech or signal coding method for encoding a signal, the coding method comprising:

coding an excitation or a fixed codebook excitation wherein the excitation or the fixed codebook excitation includes plurality of pulse pairs called a Dual Pulse Model;

wherein said Dual Pulse Model features two pulses of each pair of pulses that are always adjacent to each other with a distance of 1, the two pulses of each pair of pulses have different magnitudes and signs and only one position index for each pair of pulses are transmitted from encoder to decoder.

2. The method of claim 1, wherein the Dual Pulse Model is used as a portion of popular CELP technology.

3. The method of claim 1, further comprising the steps of:

selecting a best position of each pair of pulses within a limited set of candidate positions and only one best position index for each pair of pulses is sent to said decoder;

wherein possible magnitudes of each pair of pulses have enough variation so that the candidate positions of each pair of pulses can be limited in a relatively small range and a low complexity searching approach of the best pulse pair can be employed with local error minimization.

4. The method of claim 3, wherein the possible magnitudes of each pair of pulses are designed so that said pairs of pulses produce different high-pass effect.

5. The method of claim 3, wherein the possible magnitudes of each pair of pulses are designed so that said pairs of pulses produce different low-pass effect.

6. The method of claim 3, wherein the possible magnitudes of each pair of pulses are designed so that said pairs of pulses produce different low-pass and high-pass effect.

7. The method of claim 3, wherein the possible magnitudes of each pair of pulses are designed so that said pairs of pulses comprises the magnitude pattern of (1,−0.2), (0.5,−0.2), (1,−0.85) and (0.5,−0.85).

8. The method of claim 3, wherein the candidate positions of at least one pair of pulses cover the position candidate set {0, 1, 2, 3, 4, 5, 6, 7}.

9. The method of claim 3, wherein the best position and magnitude of each pair of uses can be jointly searched.

* * * * *